United States Patent [19]

Spademan

[11] 4,352,508

[45] Oct. 5, 1982

[54] RELEASABLE STEP-IN SKI BINDING

[76] Inventor: Richard G. Spademan, Box 6410, Incline Village, Nev. 89450

[21] Appl. No.: 110,222

[22] Filed: Jan. 7, 1980

[51] Int. Cl.[3] ..... A63C 9/08

[52] U.S. Cl. ..... 280/624; 280/625; 280/634

[58] Field of Search ..... 280/624, 625, 632, 631, 280/626, 613, 634

[56] References Cited

U.S. PATENT DOCUMENTS

| | | | |
|---|---|---|---|
| 3,325,178 | 6/1967 | Reuge et al. | 280/626 |
| 3,326,566 | 6/1967 | Salomon | 280/632 |
| 3,771,806 | 11/1973 | Hinterholzer et al. | 280/624 X |
| 3,797,841 | 3/1974 | McAusland | 280/624 |
| 3,887,205 | 6/1975 | Edmund | 280/624 |
| 4,063,752 | 12/1977 | Whitaker et al. | 280/624 |

FOREIGN PATENT DOCUMENTS

| | | | |
|---|---|---|---|
| 2293226 | 7/1976 | France | 280/624 |

*Primary Examiner*—Joseph F. Peters, Jr.
*Assistant Examiner*—Milton L. Smith

[57] ABSTRACT

A releasable step-in ski binding has movable clamping members (1,2) at the forward ends of a pair of elongated arms (21,22,21',22'). The rear ends of the arms (21,22,21',22') are coupled to a pair of transverse spring members (43,44) forming a transverse spring assembly (10). A lever member (11,11') is pivotably mounted on the binding and has a first position for compressing the rear ends of the arms (21,22,21'22') against the springs (43,44) for opening the clamping members (1) and (2). Extending from the lever member (11,11') there is provided a member (14) for receiving a ski pole tip to move the lever member (11,11') to its first position for opening the clamping members (1,2). In one embodiment a ski boot receiving member (12) for moving the lever member (11) to a second position is provided for closing the clamping members (1,2). In another embodiment a trigger member (103) between the clamping members (1,2) is provided for closing the clamping members (1,2).

16 Claims, 16 Drawing Figures

FIG. 14
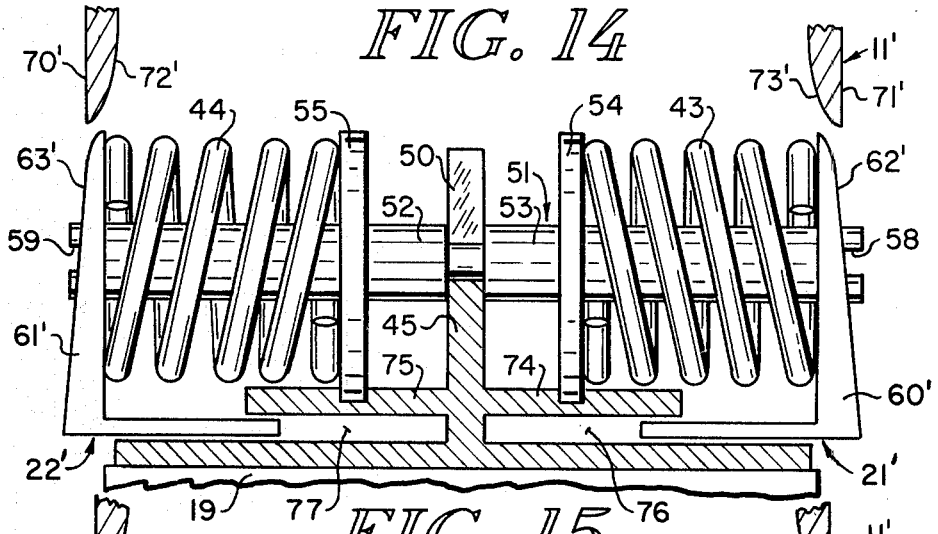
FIG. 15
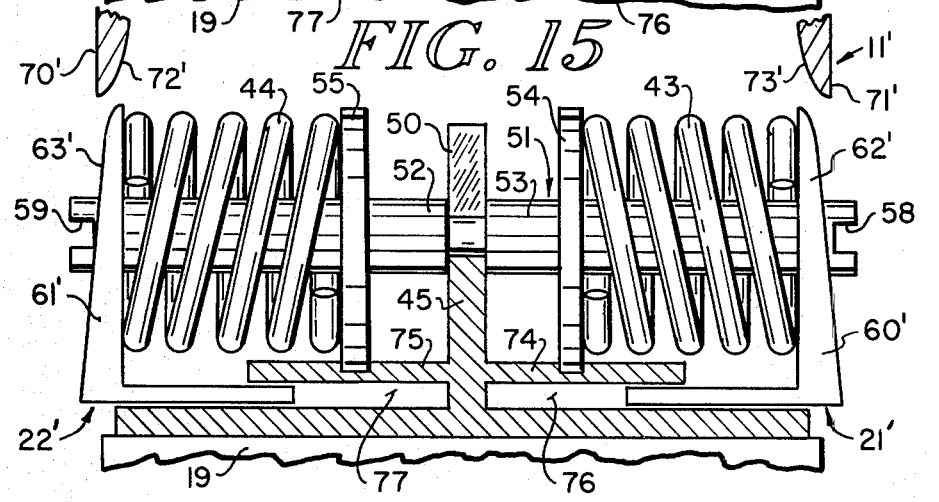
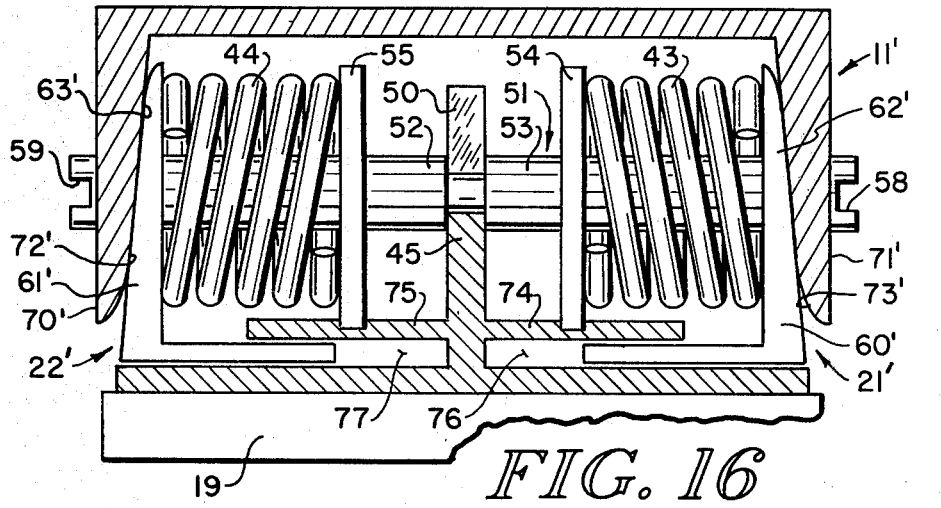
FIG. 16

RELEASABLE STEP-IN SKI BINDING

BACKGROUND OF THE INVENTION

The present invention relates to ski bindings in general and in particular to a releasable step-in type ski binding comprising a movable clamping member. The movable clamping member has an open and a closed position and is coupled to a force unit comprising a spring member for providing a clamping force for releasably securing a ski boot to a ski rearward of the toe and forward of the rear of the heel of the ski boot.

Step-in bindings greatly facilitate securing a ski boot to a ski. Before the advent of the step-in type ski binding, in order to secure a ski boot to a ski, it was often necessary for a skier to bend over and/or crouch in order to reach the binding parts for engaging the binding parts. With the step-in type ski binding, the binding parts may be set while the skier is in a comfortable and upstanding position. The ski is then placed on the ground and the skier simply places his foot in the binding and pressing downwardly causes the binding mechanism to react and releasably engage mating parts on the ski boot.

In all step-in ski bindings it is important that the various parts of the binding work freely and with minimum forces between the interfacing parts, so as to provide ease of operation and long life and reliability. In order for the binding to be easy to use, it is necessary that the activation of the binding during the step-in procedure does not cause the ski to move unduly from beneath the skier's foot. This is necessary to insure proper mating of the binding parts on the ski and the boot and is particularly important and necessary when the ski is being resecured to a ski boot as after a fall on the side of a hill or under other difficult snow and terrain conditions.

Step-in ski bindings having one or more clamping members releasably securing a ski boot to a ski rearward of the toe and forward of the rear of the heel of the ski boot are disclosed in U.S. Pat. No. 4,063,753 issued to Whitaker et al. and U.S. Pat. No. 3,887,205 issued to Edmund.

In Whitaker et al. there is provided a binding in which a force unit comprising an overcenter mechanism is located at the rear end of the binding. To voluntarily exit the binding, a skier must twist to the rear and bend over to grasp and lift the overcenter mechanism. This can be awkward and difficult under the adverse slope and snow conditions discussed above particularly if the skier is wearing bulky insulated cold-weather clothing.

In Edmund there is provided a binding in which there is located a slot in the forward end of each clamping member. To enter the binding, a boot-mounted plate is inserted in the slot and downward pressure causes the clamping member to move over center. As the downward pressure is applied, however, the ski boot is not in skiing position and there is, therefore, a tendency for the ski to move rearwardly with no convenient means for restricting the movement.

SUMMARY OF THE INVENTION

In view of the foregoing, a principal object of the present invention is a releasable step-in type ski binding for releasably securing a ski boot to a ski rearward of the toe and forward of the rear of the heel of the ski boot.

Another object of the present invention is a releasable step-in type ski binding of the type described above in which the mechanism for operating the binding comprises a ski boot-actuated mechanism for releasing a clamping member for securing the ski boot to a ski.

Another object of the present invention is a releasable step-in type ski binding of the type described above in which means are provided for voluntarily opening the binding with the tip of a ski pole or the like.

Still another object of the present invention is a releasable step-in type ski binding which is simple to use, reliable and requires a minimum of actuating forces.

In accordance with the above objects, there is provided a clamping member for releasably securing a ski boot to a ski rearward of the toe and forward of the rear of the heel of the ski boot. The clamping member comprises an elongated member pivotably mounted in the binding. At the rear end of the elongated member, there is coupled to the elongated member a spring member. Pivotably mounted adjacent to the spring member there is provided a lever member.

In one embodiment, the lever member comprises a first part for engaging the spring and a second part for receiving the heel of a ski boot. The first part is used for compressing the spring so as to open the clamping member at the forward end of the elongated member. The second part is used to close the clamping member.

In operation, as a skier enters the binding, the heel of the ski boot presses the second part of the rear lever member, causing the lever member to pivot away from the spring, permitting the spring to relax. As the spring relaxes, it pushes outwardly on the rear end of the clamping member, allowing the clamping member to engage mating parts on the ski boot.

In another embodiment, there is provided a trigger member which is set when the lever member is used to open the clamping member. Once set, the trigger member holds the clamping member open against the force of the spring until a skier steps down on the top of the trigger member. When the trigger member is depressed, and this occurs with the ski boot in skiing position, the clamping member is released, allowing the clamping member to engage mating parts on the ski boot.

BRIEF DESCRIPTION OF THE DRAWING

The above and other objects, features and advantages of the invention will become apparent from the following detailed description of the accompanying drawing in which:

FIG. 14 is a transverse cross-sectional view of the transverse spring assembly of the embodiment of FIG. 7 when the jaw members of the binding are at their closest point.

FIG. 15 is a transverse cross-sectional view of the spring assembly of the embodiment of FIG. 7 when the clamping jaws are clamping a ski boot or boot plate attached to the boot.

FIG. 16 is a transverse cross-sectional view of the transverse spring assembly of the embodiment of FIG. 7 when the jaws of the binding are in their open position.

DETAILED DESCRIPTION OF THE INVENTION

Figure 1:
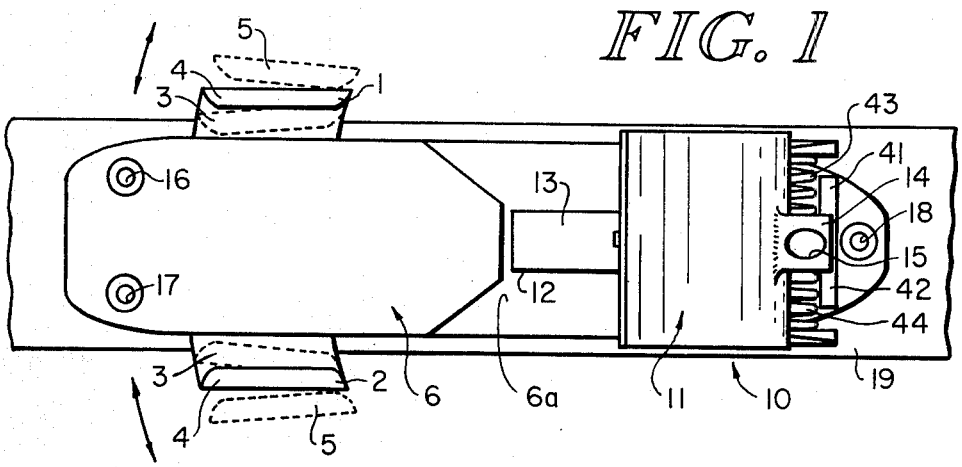
FIG. 1 is a plan view of one embodiment of a binding according to the present invention.

Referring to FIG. 1, there is provided in a binding according to the present invention a pair of jaws 1 and 2. The jaws 1 and 2 are shown in three positions: a fully closed position as shown by the broken lines at 3, a clamping position as shown by the solid lines at 4, and a fully opened position as shown by the broken lines at 5. The fully closed position at 3 occurs when no boot or boot plate is between the jaws 1 and 2 and the jaws are free to move unimpeded to their closest position. Position 4 illustrates the position of the jaws when a boot or boot plate is inserted between the jaws. Position 5 illustrates the position of the jaws when the jaws are forced to their openmost position.

Between the jaws, there is shown the upper surface of an upper housing 6 of the binding. At the rear of the housing 6 there is provided a transverse spring assembly designated generally as 10.

In the assembly 10 there is provided a lever member 11. Extending from a forward edge of the lever member 11, there is provided a heel-receiving member 12. Extending from the rear of the lever member 11, there is provided a ski-pole-tip-receiving member 14. In the member 14 there is provided a hole 15 for receiving the tip of a ski pole (not shown).

Forward of the jaws 1 and 2, there is provided a pair of counter-sunk holes 16 and 17 and to the rear of assembly 10, a counter-sunk hole 18. The holes 16, 17 and 18 are provided for mounting the binding to the upper surface of a ski designated as 19.

Figure 2:
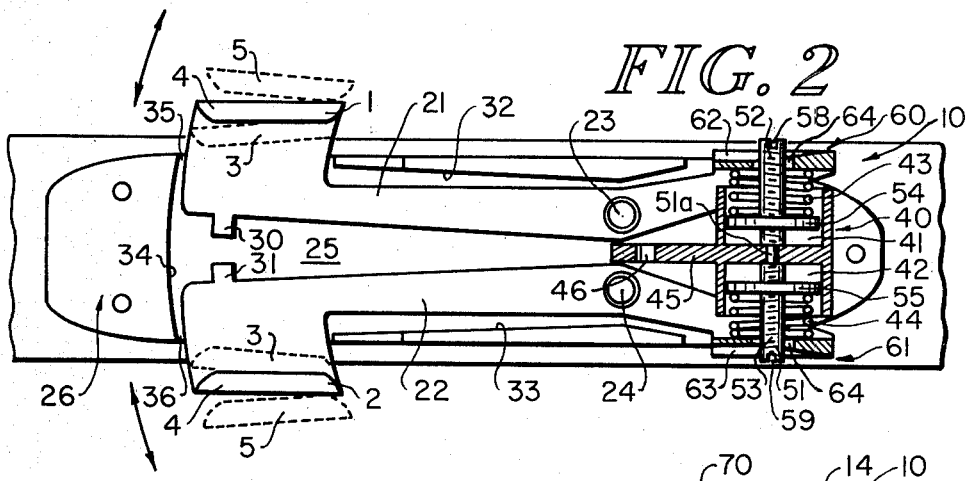
FIG. 2 is a plan view of the embodiment of FIG. 1 with the upper housing and lever member omitted for clarity and the rear of the binding shown in partial cross section.

Referring to FIG. 2, the jaws 1 and 2 extend upwardly from the forward end of a pair of arms 21 and 22, respectively. The arms 21 and 22 are pivotably mounted for rotation in a recess 25 about a pair of posts 23 and 24. The recess 25 and posts 23 and 24 are interior of a pair of side walls 32 and 33, and rearwardly of a forward wall 34 at the forward end of a lower housing 26 which is located beneath the upper housing 6 shown in FIG. 1. Extending inwardly from the forward end of the arms 21 and 22, there is provided a pair of clamp-stop members 30 and 31. Members 30 and 31 determine the distance the jaws 1 and 2 are able to move together. Additionally, the exterior forward ends of the arms 21 and 22 are positioned to pass through openings 35 and 36 provided therefor between the forward edges of the walls 32 and 33 and the wall 34.

Figure 3:
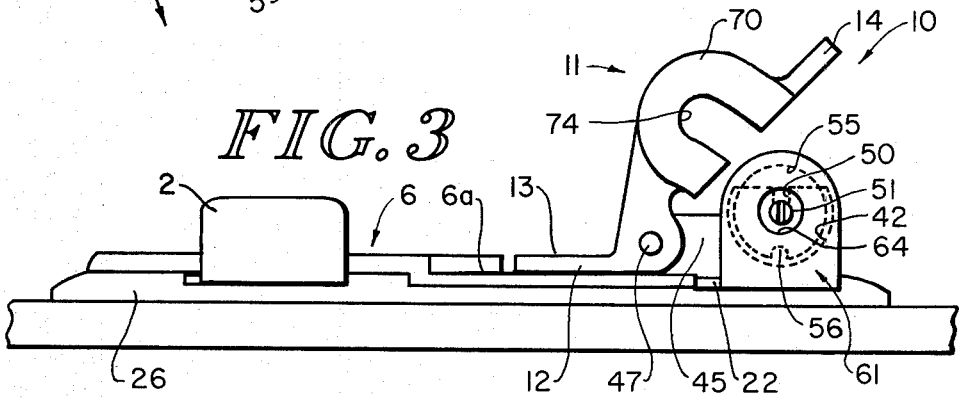
FIG. 3 is an elevation view of FIG. 1.

Referring to the rear end of the binding, as shown in FIG. 2, there is provided in assembly 10 a transverse spring housing designated generally as 40. In housing 40, there is provided a pair of generally cylindrically shaped spring cavities 41 and 42. Spring cavity 41 is provided for housing a spring 43 and spring cavity 42 is provided for housing a spring 44. As shown in FIG. 1, the cavities 41 and 42 are open at their top, exposing the springs 43 and 44. Extending forwardly from the center of the spring housing 40, between the arms 21 and 22, there is provided a mounting flange 45. At the forward end of the flange 45 there is provided a hole 46. The flange 45 and hole 46 are provided for pivotably mounting the lever member 11 in the assembly 10 as by a pin, bolt, rivet 47, or the like, as shown in FIG. 3.

As seen more clearly in FIGS. 3–6, centrally located between the spring cavities 41 and 42, there is provided, in the mounting flange 45 in the housing 40, a slot 50. The slot 50 is provided for receiving a reduced central bearing section 51*a* of a threaded stud 51. The stud 51 is provided with two sets of threads 52 and 53. Threads 52 and 53 are oppositely directed and are right and left-hand threads, respectively. Threaded on the stud 51, in the interior of the spring cavities 41 and 42, there is provided a pair of spring compression members 54 and 55. In each of the members 54 and 55, in the lower edge thereof, there is provided a key member-receiving slot 56. The slot 56 is provided for receiving a key member, to be described below with respect to FIGS. 4–6. The slot 56 in members 54 and 55 prevents a rotation of the members 54 and 55 as the stud 51 is rotated. At opposite ends of the stud 51 there is provided a pair of slots 58 and 59. The slots 58 and 59 are provided for receiving a screw driver, coin or the like for turning the stud 51.

At the rear ends of the arms 21 and 22, there is provided upstanding beveled members 60 and 61, respectively. On the exterior of the beveled members 60 and 61 there is provided an exterior compound beveled surface 62 and 63, respectively. The surfaces 62 and 63 slope downwardly outwardly and rearwardly outwardly, thereby defining a compound beveled surface in that the plane of the beveled surface describes an angle with respect to planes both perpendicular and parallel to the axis of the stud 51.

In addition to the beveled surfaces 62 and 63, there is provided in the members 60 and 61, a pair of relatively flat surfaces 62*a* and 63*a*, respectively. The beveled surfaces 62 and 63 and the flat surfaces 62*a* and 63*a* are provided for receiving a pair of corresponding surfaces 72 and 73 in a pair of wall members 70 and 71 in the lever member 11 for holding the lever member in its clamp-open position against the force of the springs 43 and 44 until pressure is brought to bear on the member 12.

In the center of each of the upstanding members 60 and 61, there is provided a hole 64. The hole 64 in each of the upstanding members 60 and 61 is provided for receiving one of the ends of the stud 51 or for providing access to the slots 58 and 59 provided in the ends thereof.

Referring to FIGS. 3–6, extending from the lower edge thereof, upwardly toward the center of the lever member 11, there is provided in the side walls 70 and 71 a slot 74. The slot 74 is provided for passing freely over the ends of the stud 51 and for providing access to the slots 58 and 59 in the ends of the stud 51.

As seen in FIG. 3, when the lever member 11 is pivoted counter-clockwise to the fullest extent possible, the upper surface 13 of the heel-receiving member 12 lies below the plane of the upper surface of the upper housing 6. This is possible because the housing 6 is provided with a recessed or lowered upper surface 6*a* in the vicinity of the heel-receiving member 12.

Figure 4:
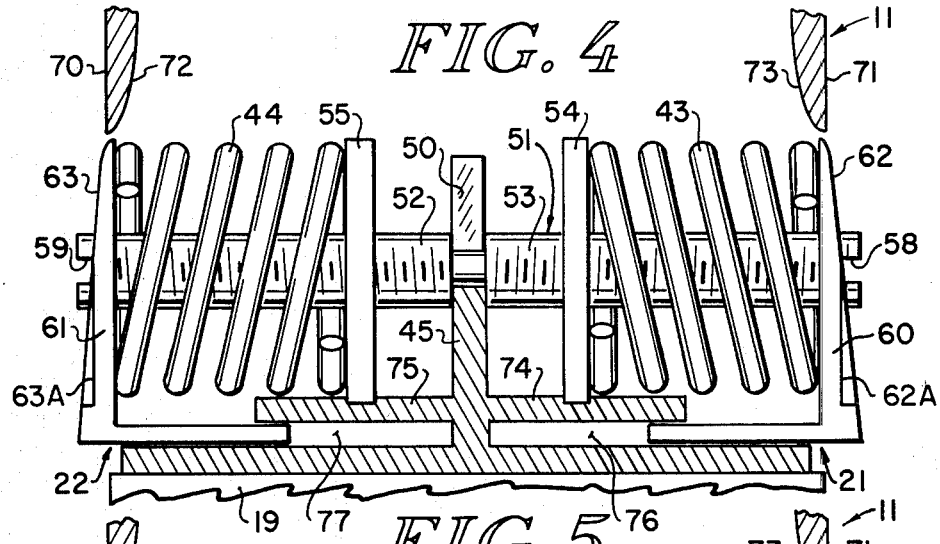
FIG. 4 is a transverse cross-sectional view of the spring assembly of the embodiment of FIG. 1 when the jaw members of the binding are at their closest point.
Figure 5:
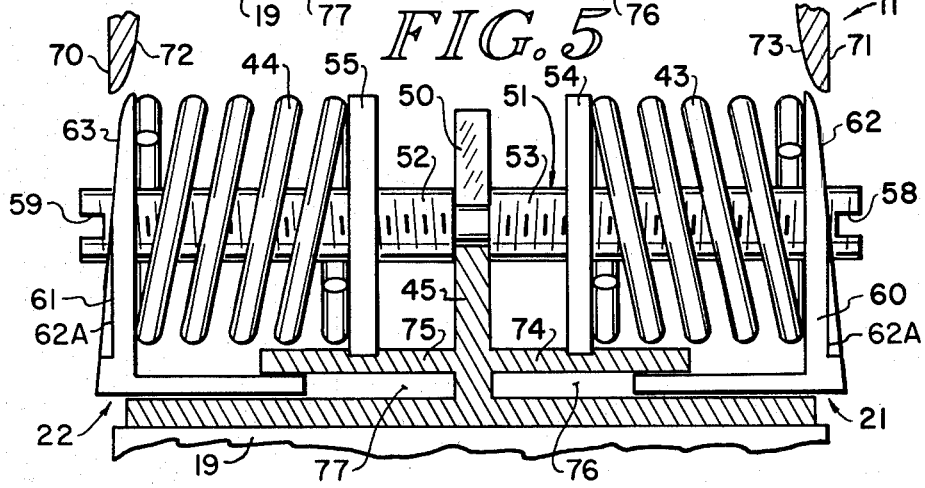
FIG. 5 is a transverse cross-sectional view of the spring assembly of the embodiment of FIG. 1 when the clamping jaws are clamping a ski boot or boot plate attached to the boot.
Figure 6:
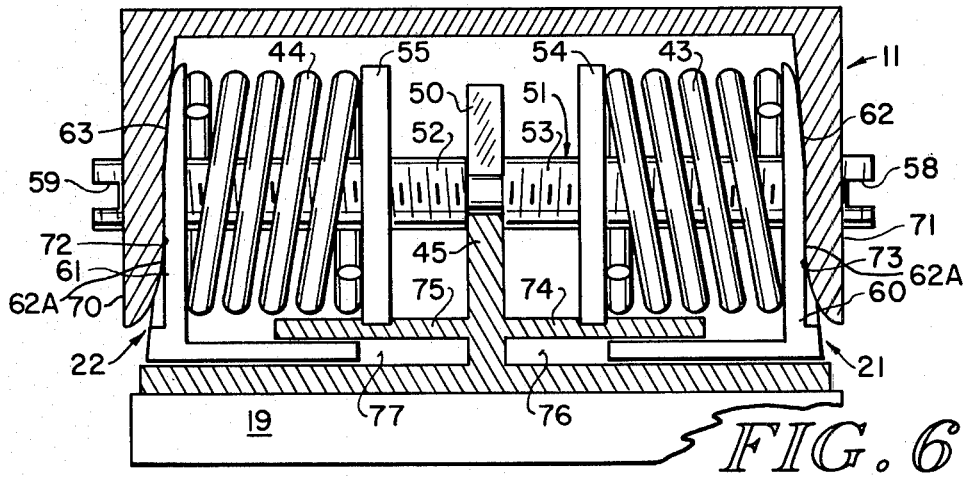
FIG. 6 is a transverse cross-sectional view of the transverse spring assembly of the embodiment of FIG. 1 when the jaws of the binding are in their open position.

Referring to FIGS. 4–6, as previously described, the beveled surfaces 62 and 63 and the flat surfaces 62*a* and 63*a* of the upstanding members 60 and 61 at the rear ends of the arms 21 and 22, respectively, are provided for slidably receiving corresponding surfaces 72 and 73 on the interior of the side wall members 70 and 71, respectively. Below the stud 51 and at the lower end of the spring compression members 54 and 55, there is provided key members 74 and 75, respectively. The key members 74 and 75 are provided for slidably engaging the key slot 56 provided therefor in the lower edge of each of the members 54 and 55 for preventing rotation of the members 54 and 55 as the stud 51 is rotated. Beneath the key members 74 and 75, there is provided a clearance space 76 and 77 for receiving interior portions of the arms 21 and 22, respectively.

In practice, when the jaw members 1 and 2 are at their closest position, the rear ends of the arms 21 and 22, and in particular the upstanding members 60 and 61, are farthest apart, as shown in FIG. 4. With the tip of a ski pole placed in the hole 15 in the member 14 at the rear of the lever member 11, the lever member 11 may be pivoted clockwise about the pin 47. As the lever member 11 is pivoted clockwise about the pin 47, the interior surfaces 72 and 73 of the side wall members 70 and 71 slidably engage the beveled surfaces 62 and 63 of the upstanding members 60 and 61 at the rear ends of the arms 21 and 22, respectively. As the surfaces 72 and 73 engage the surfaces 62 and 63, the arms 21 and 22 are caused to pivot about the posts 23 and 24, the springs 43 and 44 are compressed between the interior of the upstanding member 60 and the spring compression member 54 and the interior of the upstanding member 61 and the spring compression member 55, respectively. At the same time the jaws 1 and 2 are caused to pivot to their outermost position 5, as shown in FIGS. 1 and 2. With the jaws 1 and 2 in their outermost position 5, as shown in FIGS. 1 and 2, the springs 43 and 44 are compressed, as shown in FIG. 6.

As a skier steps into the binding, the heel of the ski boot engages the upper surface 13 of the heel-receiving member 12. As the heel of the boot engages the member 12, and a force is brought to bear thereon, the lever member 11 is caused to pivot counter-clockwise about the pin 47. As the lever member 11 pivots counter-clockwise, the side walls 70 and 71 of the lever member 11 are caused to separate from the upstanding members 60 and 61. As this occurs, the springs 43 and 44 are allowed to extend to the fullest extent possible, limited only by the width of the boot receiver or boot plate which the jaws 1 and 2 are engaging.

To adjust the force with which the jaws 1 and 2 engage a boot receiver or boot plate attached thereto, a screw driver, coin or the like is inserted in the slot 58 or 59 to turn the threaded stud 51. As the threaded stud 51 is rotated, the spring compression members 54 and 55, due to the opposite pitch of the threads 52 and 53, move in opposite directions. Accordingly, when rotated in one direction, the stud 51 will cause the spring compression members 54 and 55 to move outwardly, further compressing the springs 43 and 44, increasing the clamping force applied to the jaws 1 and 2, respectively. Conversely, when the stud 51 is rotated in the opposite direction, the spring compression members 54 and 55 are caused to move inwardly relative to each other, allowing the springs 43 and 44 to extend and thereby reduce the clamping force applied to the jaws 1 and 2, respectively.

The distance that the springs 43 and 44 are required to compress between a fully open and fully closed position of the jaws 1 and 2 is dependent on the distance between the springs 43 and 44 and the pivot posts 23 and 24 and the distance between the jaws 1 and 2 and the pivot posts 23 and 24, respectively. The clamping forces applied to the jaws 1 and 2 is also dependent on these distances. Accordingly, for any given spring, the clamping force can be adjusted by adjusting the distances mentioned. Additionally, the clamping force can be adjusted by changing the strength of the springs 43 and 44.

Referring to FIGS. 7–16, there is provided in an alternative embodiment of the present invention a step-in binding designated generally as 100. In the binding 100 there is provided many of the features described above with respect to the embodiment of FIGS. 1–6. These features bear the same identifying numbers used in FIGS. 1–6. The primed numbers below refer to features of FIGS. 1–6 which are modified in FIGS. 7–16 as described below but which otherwise function as described above with respect to FIGS. 1–6.

At the rear end of the binding 100 there is provided a lever member 11' from which is eliminated the heel-receiving member 12 of the member 11.

For momentarily engaging the springs 43 and 44, the lever member 11' is provided with a pair of downwardly depending side walls 70' and 71'. In their interior, the side walls 70' and 71' are provided with a pair of beveled surfaces 72' and 73'. The surfaces 72' and 73' are provided for slidably engaging a corresponding pair of compound beveled surfaces 62' and 63' located on the exterior surface of a pair of upstanding members 60' and 61' on the rear end of a pair of elongated clamping members 21' and 22'.

The walls 70' and 71' and surfaces 62', 63', 72' and 73' are identical to the walls 70, 71 and surfaces 62, 63, 72 and 73 of FIGS. 1–6 except that the flat surfaces 62*a* and 63*a* are omitted for facilitating the removal of the lever member 11' from the springs 43 and 44 as explained below. The clamping members 21' and 22' are identical to the members 21 and 22 of FIGS. 1–6 except for the surfaces 62' and 63' and a pair of slots 101 and 102 at the forward end thereof.

The slots 101 and 102 located at the forward ends of the members 21' and 22' are located generally between the jaws 1 and 2. Each of the holes 101 and 102 generally comprises a pair of intersecting holes of different diameters with the smaller of the holes located outwardly of the larger hole.

Figure 7:
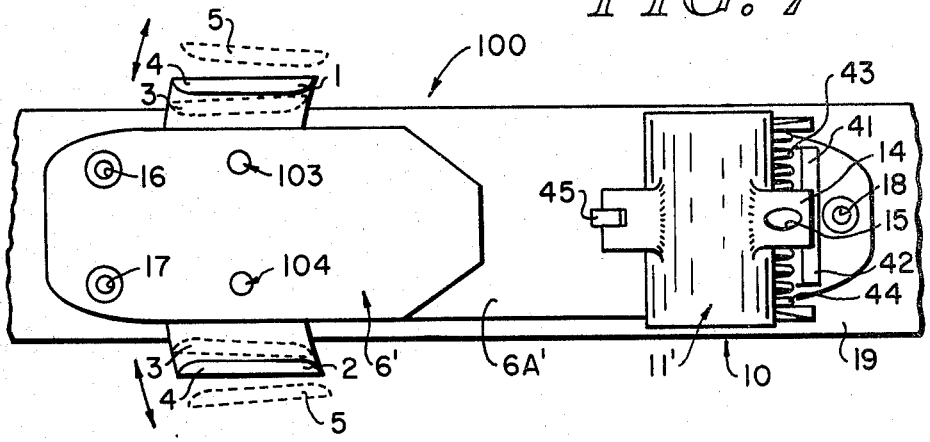
FIG. 7 is a plan view of an alternative embodiment of a binding according to the present invention.
Figure 8:
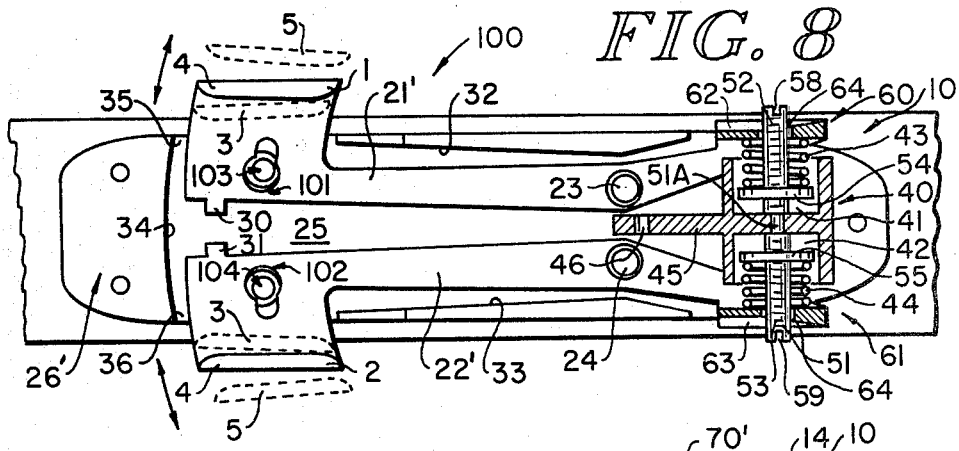
FIG. 8 is a plan view of the embodiment of FIG. 7 with the upper housing and lever member omitted for clarity and the rear of the binding shown in partial cross section.

Located in the holes 101 and 102 there is provided a pair of step-in members 103 and 104, respectively. As seen in FIG. 7, and as will be described in more detail with respect to FIGS. 10–13, the step-in members 103 and 104 project upwardly through holes provided therefor in an upper housing 6' of the binding 100 between the jaws 1 and 2. The housing 6' is identical to the housing 6 of FIG. 1–6 except for the holes for the members 103 and 104.

Referring to FIGS. 10–13, the step-in members 103 and 104 are identical. Accordingly, only step-in member 103 and the hole 101 will be described.

As described above, each of the holes 101 and 102 comprises a pair of intersecting holes of different diameters. For purposes of describing the holes, the smaller of the holes is designated as 105 and the larger of the holes is designated as 106.

The step-in member 103 is provided with a generally cylindrical, hollow upper portion 107 and a cylindrical lower portion 108 having a larger diameter. In the interior of the step-in member 103 there is provided a spring 110.

Located below the step-in member 103 there is provided in a lower housing 26' a well or hole 109. The housing 26' is identical to the housing 26 of FIGS. 1–6 except for the well 109.

To accommodate the step-in member 103, the smaller hole 105 of the two holes 101 in the clamping arm 21' has a diameter slightly larger than the diameter of the upper portion 107 of the step-in member 103. The larger diameter hole 106 of the two holes 101 in the clamping member 21' is slightly larger than the diameter of the lower portion 108 of the step-in member 103. The diameter of the well 109 in the lower housing 26' is slightly larger than the lower portion 108 of the step-in member 103 for slidably receiving the lower portion 108, as will be further described.

Figure 9:
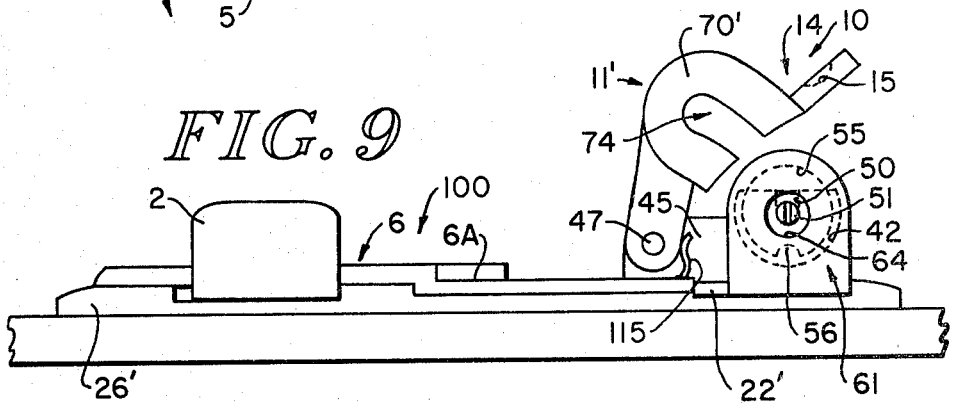
FIG. 9 is an elevation view of FIG. 7.
Figure 10:
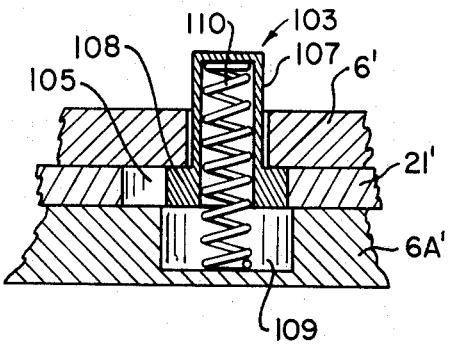
FIG. 10 is a partial cross-sectional view of a step-in member in a clamp-open condition according to the present invention.
Figure 11:
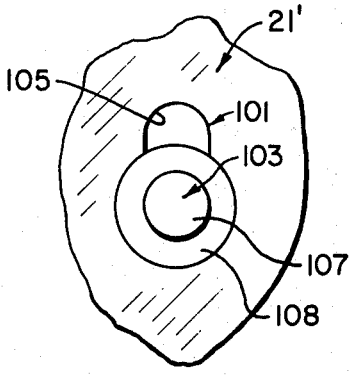
FIG. 11 is a plan view of FIG. 10.

In operation, as the lever member 11' is pivoted downwardly by a ski pole or the like inserted in the hole 15 provided therefor, the beveled surfaces 72' and 73' of the side walls 70' and 71' of the lever member 11' engage the corresponding beveled surfaces 62' and 63' of the upstanding members 60' and 61' at the rear ends of the clamping members 21' and 22'. As the upstanding members 60' and 61' of the clamping members 21' and 22' are squeezed together against the force of the spring members 43 and 44, the forward ends of the clamping members 21' and 22' are pivoted outwardly. As the forward ends of the clamping members 21' and 22' are pivoted outwardly, the spring members 110 in the step-in members 103 and 104 push the step-in members 103 and 104 upwardly through the holes provided therefor in the upper housing 6'. At the same time the lower portion 108 of the members 103 and 104 becomes seated in the larger diameter hole 106 of the two holes 101, as shown in FIG. 11. With the lower portion 108 of the step-in members 103 and 104 seated in the larger diameter hole 106, the step-in members 103 and 104 are set. With the step-in members 103 and 104 set, the ski pole or the like inserted in the hole 15 provided therefor in the lever member 11' can be removed therefrom and a leaf spring 115 or the like bearing against a rear surface of the lever member 11' will pivot the lever member 11' in a counter-clockwise direction away from the spring members 43 and 44, as shown in FIG. 9.

With the step-in members 103 and 104 set, and the lever member 11' free of the spring members 43 and 44, a skier may insert a ski boot into the binding.

Figure 12:
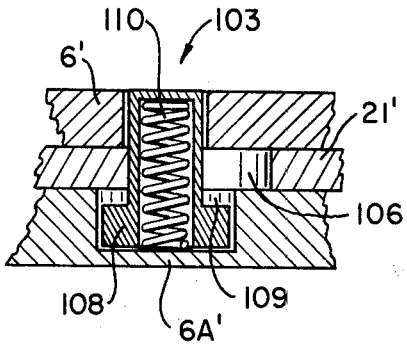
FIG. 12 is a partial cross-sectional view of the step-in member of FIG. 10 in a clamp-closed condition.

As the skier inserts a ski boot into the binding with the boot plate provided thereon located in skiing position between the jaw members 1 and 2, contact will be made with the upper surface of the step-in members 103 and 104. As pressure is brought to bear thereon, the step-in members 103 and 104 are pushed downwardly into the hole 109 in the lower housing 26, as shown in FIG. 12. As the step-in member 103 enters the hole 109, the lower portion 108 thereof is removed from the larger diameter hole 106 of the pair of holes 101 in the clamping member 21'. As the lower portion 108 is removed from the hole 106, the spring 43, pushing against the rear of the clamping arm 21', pivots the forward end of the clamping arm 21' inwardly as shown by the arrow in FIG. 13, until the upper portion 107 of the step-in member 103 is located in the smaller hole 105 of the two holes 101 in the clamping member 21'.

Figure 13:
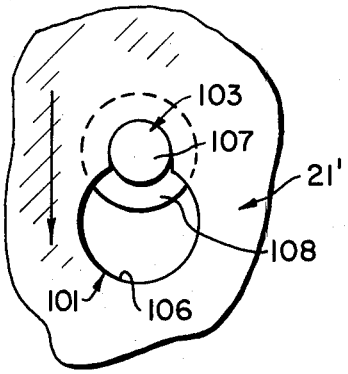
FIG. 13 is a plan view of FIG. 12.

While the upper portion 107 of the step-in member 103 is shown in FIG. 13 to be fully seated in the smaller diameter hole 105 of the pair of holes 101, it is understood that, if the width of the boot plate or the width of a ski boot limits the distance the jaws 1 and 2 are permitted to close, the upper portion 107 of the step-in members 103 and 104 would not be fully seated in the smaller diameter hole 105 of the pair of holes 101. On the other hand, if the width of the boot plate of the boot is smaller requiring that the jaws 1 and 2 move closer together than shown, then the smaller diameter hole 105 of the pair of holes 101 may be enlarged or elongated to permit the jaws 1 and 2 to move closer together.

While two embodiments of the present invention are described in detail, it is contemplated that various modifications and changes may be made to the embodiments described without departing from the spirit and scope of the present invention. Accordingly, it is intended that the scope of the invention not be limited to the embodiments described but rather be determined by reference to the claims hereinafter provided and their equivalents.

What is claimed is:

1. A releasable ski binding including a clamping member movable between an opened and a closed condition and being coupled to an elongated force unit for providing a clamping force for releasably securing a ski boot to a ski rearward of the toe and forward of the rear of the heel of the ski boot when the clamping member is in its closed condition comprising:

means for mounting said force unit on said binding with its longitudinal axis transverse to the longitudinal axis of the binding; means coupling said force unit to said clamping member for biasing said clamping member to its closed condition; and step-in means shiftably mounted on said binding for releasably holding the clamping member in its opened condition when the step-in means is at a first position on the binding, said step-in means being movable to a second position in response to a ski boot placed in skiing position on the binding to release said clamping member and allow it to move to its closed condition under the bias action of said force unit.

2. A releasable ski binding according to claim 1 wherein said coupling means for coupling said force unit to said clamping member comprises an arm pivotally mounted on the binding, said clamping member being at one end of the arm, the other end of the arm engaging said force unit.

3. A releasable ski binding according to claim 2 wherein said force unit comprises a coil spring, said arm having a projection on its other end, said projection engaging one end of said coil spring, said arm being pivotally mounted intermediate its ends on said binding.

4. A releasable ski binding according to claim 1 wherein said step-in means comprises a first means for moving said step-in means to its first position and a second means for moving said step-in means to its second position.

5. A releasable ski binding according to claim 4 wherein said force unit comprises a spring means, said first means for moving said step-in means to its first position comprises means for distorting said spring means and said second means for moving said step-in means to its second position comprises means for relaxing said spring means.

6. A releasable skibinding according to claim 5 wherein said step-in means comprises a lever member, said distorting means comprises means for moving said lever means into contact with said spring means and said relaxing means comprises means for moving said lever means from said spring means.

7. A releasable ski binding according to claim 6 wherein said means for moving said lever member into contact with said spring means comprises means for receiving the tip of a ski pole and said means for moving said lever member from said spring means comprises means for receiving pressure from a ski boot being placed in skiing position in said binding.

8. A releasable ski binding according to claim 5 wherein said step-in means comprises a movable step-in member having a clamp-open position for engaging said clamping member and means for moving said step-in member from a clamp-closed position to its clamp-open position when said spring means is distorted.

9. A releasable ski binding according to claim 8 comprising means for moving said movable step-in member from its clamp-open position to its clamp-closed position in response to the pressure of a ski boot being placed in skiing position in said binding.

10. A releasable ski binding according to claim 1 comprising means for adjusting the magnitude of said bias force provided by said force unit.

11. A releasable ski binding according to claim 10 wherein said force unit comprises a spring member and said clamping force-adjusting means comprises means for compressing said spring member against said coupling means coupling said force unit to said clamping member.

12. A releasable ski binding according to claim 11 wherein said coupling means coupling said force unit to said clamping member comprises an upstanding beveled member abutting one end of said spring member and said means for compressing said spring member against said coupling means comprises a compression member abutting the opposite end of said spring member and means for moving said compression member relative to said upstanding beveled member.

13. A releasable ski binding according to claim 12 wherein said compression member moving means comprises a threaded member mounted coaxially with said spring member and means for threadably engaging said threaded member and said compression member.

14. A releasable step-in ski binding comprising:

an elongated arm member movably mounted in said binding for rotation about a vertical axis;

a clamping member located on one end of the elongated arm;

an elongated spring member having its longitudinal axis generally horizontal and transverse to the longitudinal axis of the binding; and means for coupling said spring member to the opposite end of said elongated arm, said elongated arm being movable for moving said clamping member between an opened and a closed position as said spring member is compressed and extended; means movable from a clamp-closed condition to a clamp-opened condition for compressing said spring member to allow said arm to move said clamping member to said opened position, said spring member compressing means being operable to releasably hold the clamping member in its opened position and being movable to its clamp-closed condition in response to the pressure of a ski boot being placed in skiing position in said binding for allowing said spring member to extend to thereby release and move said clamping member into its closed position.

15. A releasable, step-in skin binding comprising: a support; an arm pivotally mounted intermediate its ends on said support for rotation about a generally vertical axis, said arm having a clamping member thereon adjacent to one end thereof; an elongated spring mounted on the support adjacent to the opposite end of the arm, said opposite end of the arm being coupled to the spring, said spring having its longitudinal axis generally horizontal and transverse to the longitudinal axis of the arm, said arm being movable from a clamp-opened position to a clamp-closed position as the spring is allowed to change from a collapsed condition to an expanded condition; and means shiftably mounted on the support and movable in one direction relative thereto for compressing said spring and releasably holding the spring in a compressed condition, said means being movable in the opposite direction in response to the placement of a ski boot in skiing position on the support to release the spring and allow it to expand to thereby cause the arm to move to said clamp-closed position.

16. A ski binding as set forth in claim 15, wherein said spring is a coil spring, said compressing and holding means including a lever member pivotally mounted intermediate its ends on the support.

* * * * *